US005762182A

United States Patent [19]

Faber

[11] Patent Number: 5,762,182

[45] Date of Patent: Jun. 9, 1998

[54] CURRENT LIMITING CIRCUIT BREAKER

[75] Inventor: Timothy Robert Faber, Marion, Iowa

[73] Assignee: Square D Company, Palatine, Ill.

[21] Appl. No.: 758,992

[22] Filed: Dec. 2, 1996

Related U.S. Application Data

[63] Continuation of Ser. No. 557,763, Nov. 13, 1995, Pat. No. 5,579,901, which is a continuation of Ser. No. 401,834, Mar. 10, 1995, Pat. No. 5,466,903, which is a division of Ser. No. 155,411, Nov. 19, 1993, Pat. No. 5,418,343, which is a continuation of Ser. No. 781,055, Oct. 18, 1991, Pat. No. 5,278,373.

[51] Int. Cl.[6] ..... H01H 23/00

[52] U.S. Cl. ..... 200/401; 200/333

[58] Field of Search ..... 200/400, 401; 337/349, 333, 6; 335/35, 45

[56] References Cited

U.S. PATENT DOCUMENTS

| | | | |
|---|---|---|---|
| 4,030,060 | 6/1977 | Mrenna et al. | 337/50 |
| 4,038,618 | 7/1977 | Gryctko | 335/23 |
| 4,695,814 | 9/1987 | Yoshiaki et al. | 337/77 |
| 4,922,220 | 5/1990 | Livesey et al. | 337/82 |

*Primary Examiner*—David J. Walczak
*Attorney, Agent, or Firm*—Larry I. Golden; Kareem M. Irfan; Wayne M. Stoppelmoor

[57] ABSTRACT

A molded plastic current limiting circuit breaker includes an interrupter assembly that includes an over-molded magnet, arc stack, baffle stack, and a chamber liner in which a trip unit is described.

4 Claims, 14 Drawing Sheets

16
187
186
150
150
152
188
14
17
15
148
18
31
43
41
160
187
152
80
5
76
9
9
34
36
38
5
7
7
154
11
27
21
184
25
23
48
45
146
45
45
44
46
12

CURRENT LIMITING CIRCUIT BREAKER

CROSS REFERENCE TO RELATED APPLICATION

This application is a continuation of application Ser. No. 08/557,763, now U.S. Pat. No. 5,579,901 filed Nov. 13, 1995, and entitled "Current Limiting Circuit Breaker" which was a continuation of application Ser. No. 08/401,834, now U.S. Pat. No. 5,466,903, filed Mar. 10, 1995, and entitled "Current Limiting Circuit Breaker", which was a divisional of application Ser. No. 08/155,411, filed Nov. 19, 1993, and entitled "Current Limiting Circuit Breaker", now U.S. Pat. No. 5,418,343, which was a continuation of application Ser. No. 07/781,055, filed Oct. 18, 1991 and entitled "Current Limiting Circuit Breaker", now U.S. Pat. No. 5,278,373.

BACKGROUND OF THE INVENTION

Current limiting circuit breakers are well known in the prior art. Examples of such circuit breakers are disclosed in U.S. Pat. Nos. 3,943,316, 3,943,472, 3,943,473, 3,944,953, 3,946,346, 4,612,430, and 4,618,751 which are assigned to the same assignee as the present application, and which are hereby incorporated by reference. Basically, a current limiting circuit breaker comprises a base and cover, a stationary contact, a movable contact secured to a rotatable blade, arc interrupting chamber, an operating mechanism for opening and closing the contacts, and a trip unit which releases the operating mechanism when a predetermined amount of current is exceeded.

Before the present invention, molded case current limiting circuit breakers were large, labor intensive, part intensive devices that had several areas of performance imitations. These circuit breakers provide movable contact arrangements coupled to operating mechanisms that open the circuit at high level short circuits. This is accomplished through the use of thermally responsive tripping elements, magnetic tripping elements, and parallel conductor blow open designs respectively.

A need, therefore, exists for an improved circuit breaker design that requires fewer parts, is easier to assemble, and is compact in design.

Current limiting circuit breakers require a single low-mass blade design and thusly the resistance allocation of the circuit breaker is skewed toward the limiter. This places rigorous requirements on the trip unit thermal section in that it must respond quickly to protect the limiter from burnout and use only a relatively small percentage of the total circuit breaker resistance so that total circuit breaker resistance is minimized. Some prior art circuit breakers use current transformers to accomplish this task. This approach is more expensive, has more parts, and may not be suitable for direct current applications. Some prior art current limiting circuit breakers use a conventional bimetal (thermal) approach, however, its overall circuit breaker resistance is significantly higher.

Thermal-magnetic circuit breakers interrupt current flowing through a circuit that exceeds a predetermined value. Generally, the thermal portion, of the circuit breaker's trip unit, determines when an overload conditions exists and then "trips" the circuit breaker, while the magnetic portion causes the circuit breaker to "trip" when a short circuit is sensed. Some applications require the circuit breaker contacts to remain closed during a short period of time while a high current level is experienced, such as during initial start up of certain types of equipment (ie. electric motors). This (short) initial current is commonly called inrush current.

Different types of equipment require various amounts of inrush currents. Therefore it is desirous to be able to adjust the level at which the circuit breaker will trip, so that nuisance tripping will not occur during the start up of this equipment. The magnetic portion can be adjusted to trip the circuit breaker at a particularly high level of current, commonly called the magnetic trip level because the trip unit uses a magnetic flux circuit to determine the level of current flowing through the current path.

A method most commonly used to adjust the magnetic trip level is to adjust the magnetic trip force required to trip the circuit breaker. The current path is routed through the middle of a yoke having an armature proximate thereto. A spring/screw assembly is connected to the armature at one end and the tripping mechanism and the other end. As current flows through the current path, a magnetic flux current is generated in the yoke, creating a magnetic force that pulls the armature towards the yoke. The greater the current, the greater the magnetic force and the more the armature travels towards the yoke. At a predetermined current level, the armature has travelled far enough to trip the circuit breaker. The spring force in the spring/screw assembly serves to counteract the magnetic force. The predetermined current level is established by varying the spring force by changing the length of the spring/screw assembly. The length of the spring/screw assembly can be varied by threading the screw into and out of the spring. In the prior art the magnetic adjust screw engages all of the active coils or the spring, creating calibration errors among other things. The torque required to engage the spring increases dramatically with the number of coils engaged resulting in spring wind-up when a certain nominal limit of coils are engaged. In addition, since spring rate is a function of the number of active coils, as more coils are engaged, the spring rate of the spring increases creating errors in the accuracy of the high-low magnetic adjustment range of the trip unit.

SUMMARY OF THE INVENTION

The device of the present invention generally relates to molded case circuit breakers and, more particularly, a current limiting circuit breaker that consist of a molded enclosure, interrupter, operating mechanism, current path, trip unit, connectors, and internal accessories. This molded case current limiting circuit breaker is capable of interrupting 200,000 Amps of electrical fault current at 240 and 480 volts and 100,000 Amps of electrical fault current at 600 Volts. This high performance is accomplished by using a single pair of contacts to carry the current under normal conditions and to open the circuit under abnormal conditions.

Under high level short circuit conditions a laminated over-molded magnet enhances the forces generated by the current travelling in opposite directions through parallel conductors to separate the contacts.

Objects of the invention include: top-down assembly, reduced part count, sealing and insulating (eliminate Room Temperature Vulcanization (RTV)), late point product identification, modular design and construction for future modifications, making small modifications to existing modules to fit customers needs, add or subtract modules to fit the customer's needs, take module out, modify it, insert and have a totally different circuit breaker.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

For exemplary purposes, the invention is shown and described with respect to a three-pole circuit breaker, although the various aspects of the invention are equally applicable to circuit breakers of a different number of poles. The three-pole circuit breaker constructed in accordance with the teachings of the present invention is shown in the Figures having an enclosure, an interrupter assembly, an operating mechanism, a trip unit, connectors, and field installable accessories. The aforementioned subassemblies being described hereinafter. The aforementioned circuit breaker was designed for top down assembly in which all of the parts are inserted into the circuit breaker base from the top and are secured to the base by threading screws into threaded inserts that are molded into the base, thereby reducing labor costs.

ENCLOSURE

Figure 1:
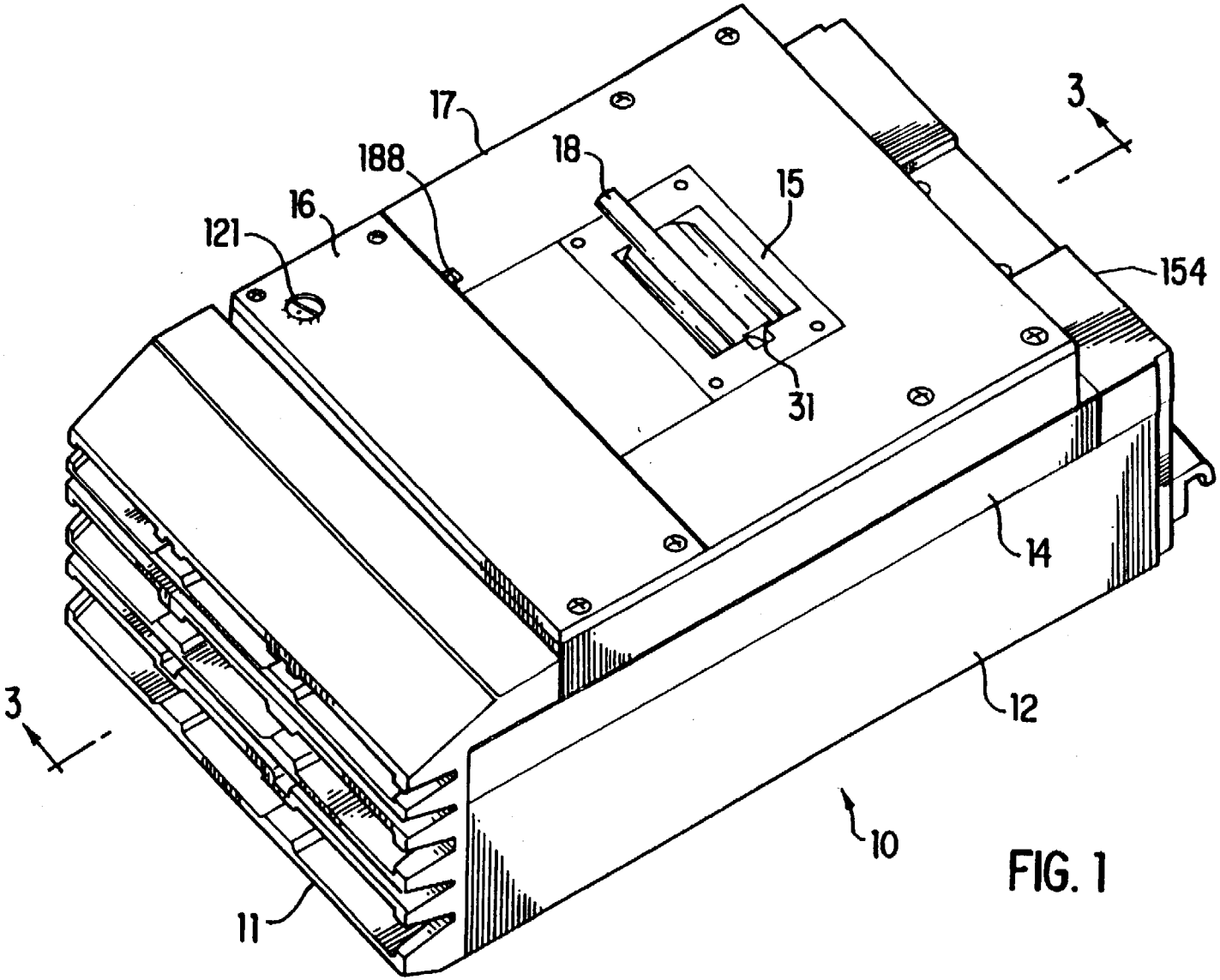
FIG. 1 is a perspective view of a three-pole current limiting circuit breaker constructed in accordance with the present invention.

Referring to FIG. 1, a circuit breaker 10 is shown having a base 12, cover 14, shroud 11, trim cover 16, access cover 17, escutcheon 15, and operating handle 18, all preferably made of molded insulating material.

Figure 2:
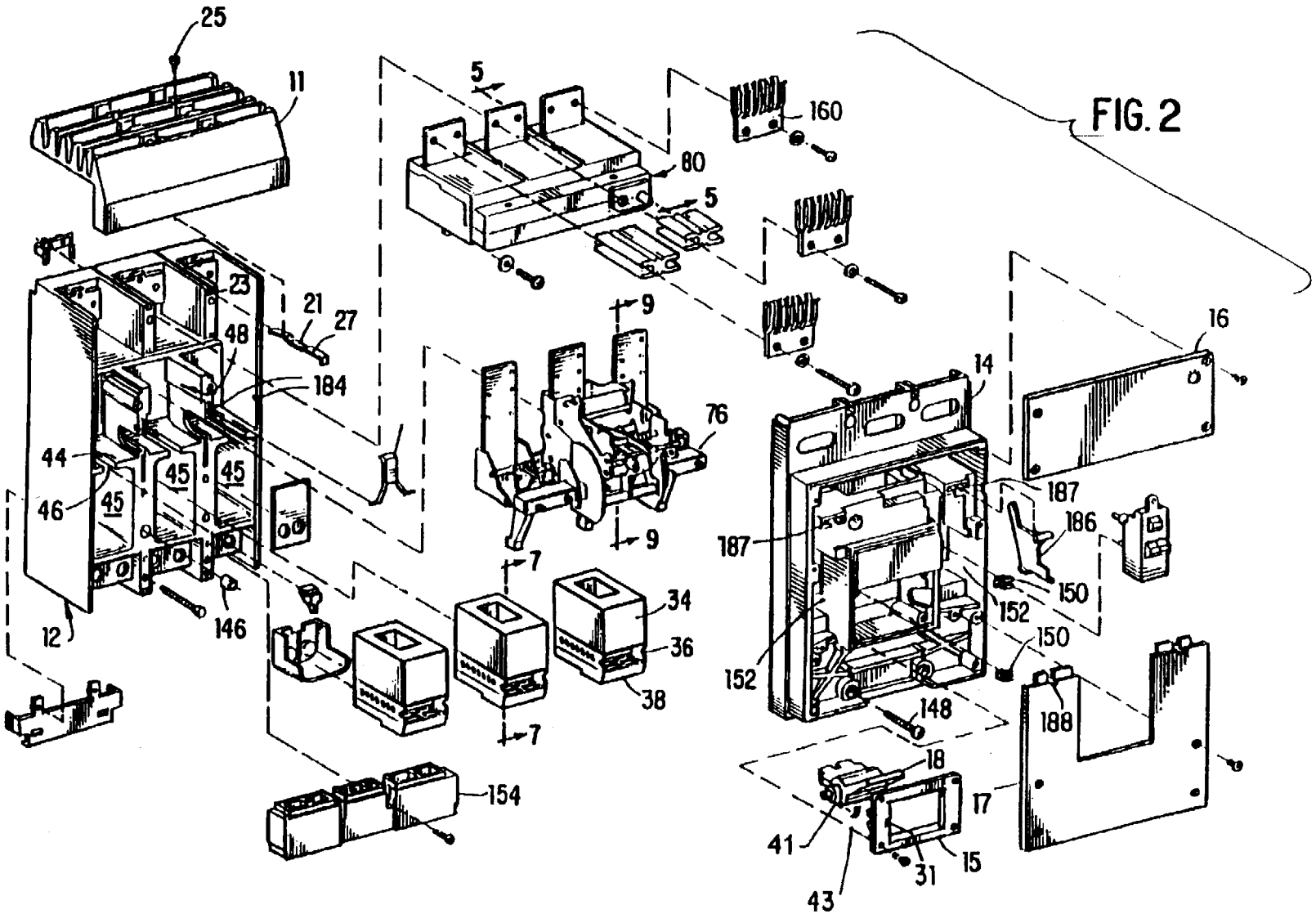
FIG. 2 is an exploded, perspective view of the subassemblies of the current limiting circuit breaker of FIG. 1.

Now referring to FIG. 2, the molded plastic base 12 is shown having all of the circuit breaker components inserted from the top and having several separate compartments including interruption compartments 45 and operating mechanism compartment 48 molded therein. After all of the circuit breaker components are inserted into the base 12, from the top, the cover 14 is secured to the base 12 by screws 148 (seen in FIG. 2) inserted from the top. All of the circuit breaker parts are secured from the top by fastening devices, such as screws, that are secured into threaded inserts 146 being molded into part fastening locations in the base 12. Base 12 has T-slots 23 integral therein for receiving shroud mounting strips 21 that are formed to snuggly fit into the T-slots 23.

The cover 14 secures the circuit breaker components in the base 12 and is secured in place from the top using screws similar to screw 148. The cover 14 also provides accessory pockets 152 for accessories to be installed therein, a pivot point for the operating handle 18, and incorporates exhaust ports (not shown, located at the bottom of the cover 14). The exhaust ports are rectangular openings having three sides formed from openings in the cover and having the forth side formed by the base 12 when the base 12 and cover 14 are secured together. The seal between the base 12 and cover 14 is a snug fit with all of the internal parts, thereby eliminating the need for sealers, such as Room Temperature Vulcanization (RTV) material. Snap receptacles 150, such as the one described in U.S. Pat. No. 5,005,880, which is assigned to the assignee of the present application, and is incorporated herewith by reference, are fastened into the cover 14 to provide a method of securing field installable accessories into the circuit breaker. Terminal blocks (not shown) are other items that are secured to the cover 14. An additional function of the cover 14 is to provide a top ceiling for the interruption and arc chambers.

After the cover 14 is secured to base 12, the shroud 11 is then installed by fitting over the base and cover assembly and secured into place by shroud mounting screws 25 fitting through holes in the shroud and cooperatively threading onto shroud mounting strip holes 27 in the shroud mounting strips 21. Shroud 11 is a molded thermoplastic part that enables the circuit breaker to work with I-line panelboards, such as the one described in U.S. Pat. No. 3,346,777 to Leonard et al. entitled "Electric Circuit Breaker and Mounting Means Therefor", which is assigned to the assignee of the present application and is incorporated herewith by reference. The shroud protects the I-line jaws 160 from abuse and provides thru air and over surface electrical spacings.

The operating handle 18 has an integral inner arcuate shoulder portion 41 having a multi-color status indicator 43 secured thereto for indicating the operation status of the circuit breaker. After the operating handle is assembled into the cover 14, escutcheon 15 is mounted to the cover 14 for positioning and securing the operating handle 18 into place and to seal around the operating handle 18. Escutcheon 15 has a status viewing aperture 31 (FIG. 1) therein for viewing the position of the multi-colored status indicator and determining the status of the circuit breaker.

Trim cover 16 is secured to the cover 14 after the trip unit 80 has been installed into the circuit breaker. A face plate label is applied over the trim cover 16 to conceal the screws and to inhibit tampering with the circuit breaker. Accesss cover 17 is secured to the cover 14 after the field installable accessories have been installed into the accessory pockets 152 in the cover 14. The trim cover 16 is not removable after the circuit breaker leaves the factory whereas the access cover 17 may be removed in the field.

Two molded plastic accessory actuators 182, one on each outside pole, are shown, each rotating about two pivot points 184 in the base 12 and secured in place by the cover 14. The accessory actuators 182 actuate the accessories and eliminate the pressure, that is generated during circuit breaker contact separation from inside of the circuit breaker to the accessory pockets 152 by sealing up the hole (not shown) in the cover 14.

The lug cover 154 engages with the exhaust ports created by sealing the cover 14 to the base 12 to provide a precise fit for directing exhaust gasses to avoid arc mixing or striking to nearby ground.

Two push-to-trip actuators 186 are provided per circuit breaker and are located at each outer pole each being placed in and rotating about a pivot point 187 in the cover 14 and are secured in place by the trim cover 16. One of the push-to-trip actuators is exposed to the user thru the push-to-trip access aperture 188 in the access cover 17 for providing a manual push-to-trip function by allowing the circuit breaker user to exercise the trip function manually. The manual push-to-trip actuator 186 is a accessory interface that communicates a trip signal from the accessories to the circuit breaker trip function and provides a resetting function for the under voltage trip type of accessories. Field installable accessories interact with a push-to-trip actuator 186 causing the trip crossbar 84 (in the trip unit, FIG. 4) to trip the circuit breaker. The push-to-trip actuator 186 provides an Under Voltage Relay (UVR) reset by having the trip crossbar 84 (FIG. 4) pushing on the push-to-trip actuator which in turn resets the under voltage relay module.

INTERRUPTER ASSEMBLY

Figure 3:
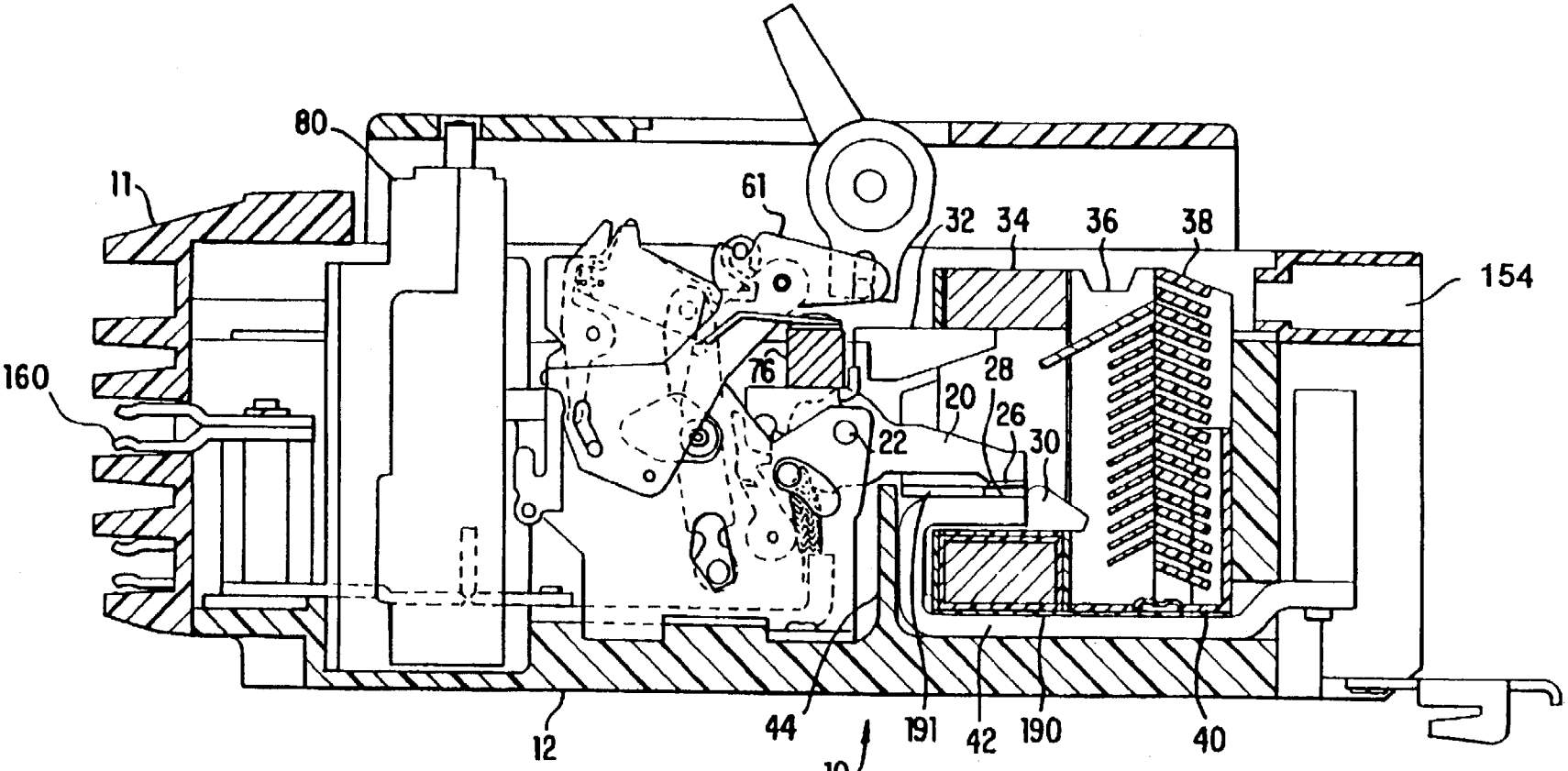
FIG. 3 is a longitudinal sectional view of the current limiting circuit breaker of FIG. 1, taken generally along the line 3—3 of FIG. 1 and showing a center pole thereof with parts in an ON position.
Figure 6:
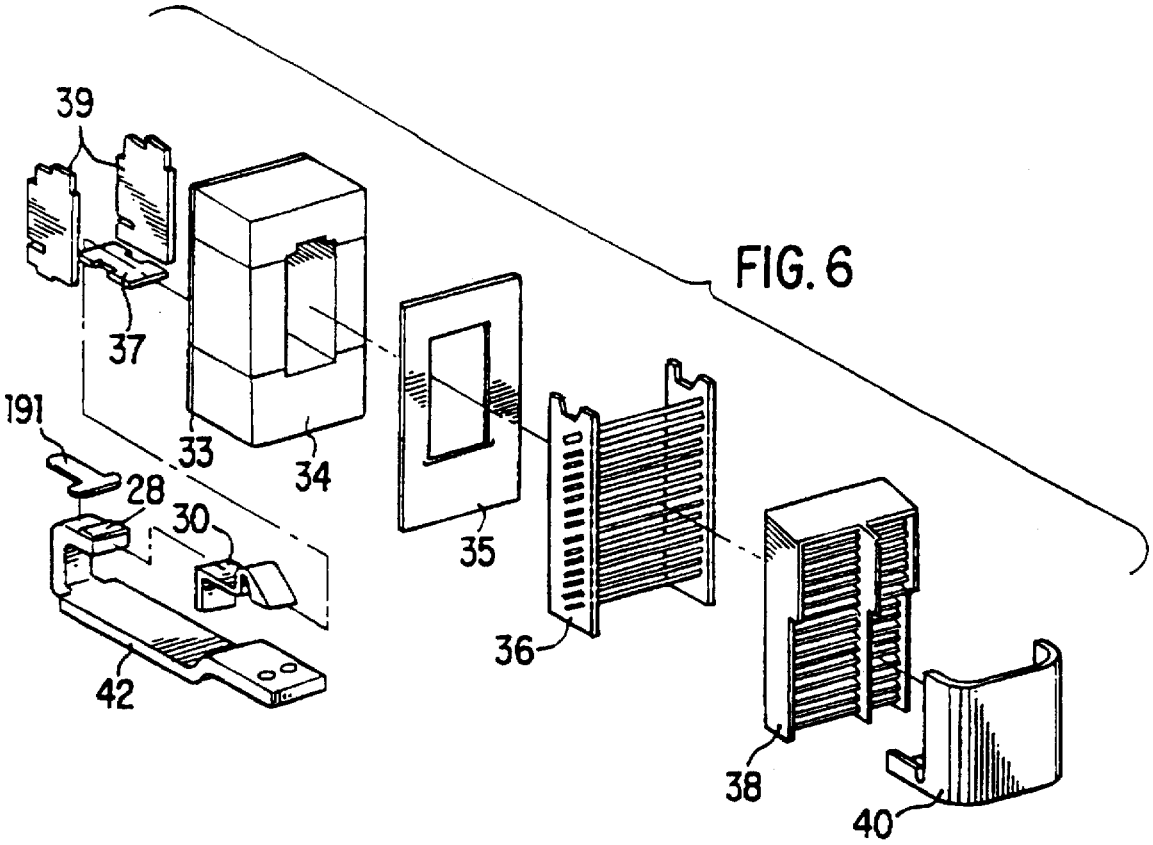
FIG. 6 is an enlarged, exploded, perspective view of the parts that fit into the interrupter compartment of any one pole of the current limiting circuit breaker of FIG. 1.
Figure 7:
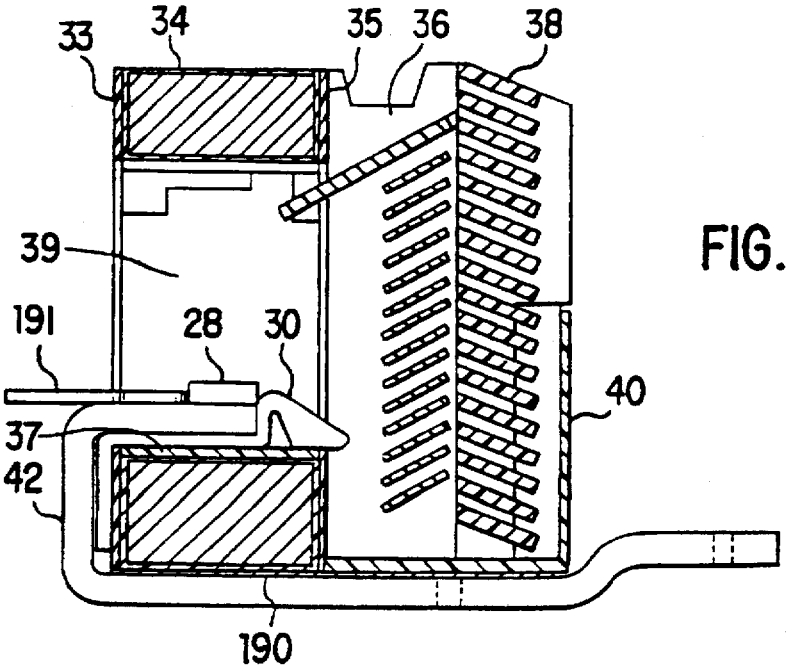
FIG. 7 is a cross sectional view of the parts that fit into the interrupter compartment of any one pole of the current limiting circuit breaker of FIG. 1, taken generally along the line 7—7 of FIG. 2.

Referring now to FIGS. 3, 6 and 7, there is shown the interrupter assembly consisting of a blade 20, a blade stop 32, a movable contact 26, a stationary contact 28, an arc runner 30, an over-molded magnet 34, an arc stack 36, a baffle stack 38, a chamber liner 40, and a current path 42.

The current path 42 is shown running along the bottom of the base 12 and then bending into a generally u-shape around the bottom portion of over-molded magnet 34 having a stationary contact 28 secured thereto using a well known securing method. An insulator 190 is placed between the current path 42 and the over-molded magnet 34. An arc runner 30 is secured between the over-molded magnet 34 and the current path 42. The arc runner 30 is automatically electrically connected to the current path 42 at the time of assembly without a brazing or welding operation and therefore requires no added fasteners to effect that electrical connection. A T-shaped insulator 191 is placed above the current path 42 and generally adjacent to the stationary contact 28.

Compartment separation wall 44 is shown having blade opening 46 (shown in FIG. 2) therein, with blade 20 protruding therethrough. Movable contact 26 is secured to the blade 20 by a well known securing procedure. Movable contact 26 engages stationary contact 28, which is secured to the upper portion of the current path 42, when the circuit breaker is in the ON/CLOSED position.

Interrupter compartment 45 (FIG. 2) includes over-molded magnet 34, arc stack 36, and baffle stack 38 assemblies, these specific assemblies being described in further detail in U.S. Pat. No. 4,618,751, which is assigned to the assignee of the present application and is incorporated hereby reference. A part that eliminates the need for RTV material that was needed for sealing the circuit breaker described in the aforementioned '751 patent will hereinafter be described. Chamber liner 40 is inserted straight down into the interruption compartment 45 (seen in FIG. 2) after the terminal and over-molded magnet 34 have been installed thereby ensuring a close sealing fit where the terminal penetrates the end wall of the circuit breaker. An arc stack 36 is then inserted into the interrupter compartment 45 followed by a one piece molded baffle stack 38 that drops into place behind the arc stack 36. All of the aforementioned parts are inserted into the base 12 from the top.

The over-molded magnet 34 comprises a plurality of steel plates grouped together and being over molded with thermoplastic. Over-molded magnet 34 physically surrounds the blade 20, blade stop 32, stationary and movable contacts 28 and 26, a portion of the current path 42, and arc runner 30. The over-molded magnet 34 greatly increases the magnetic repulsion force between the movable and stationary contacts to rapidly accelerate their separation by concentrating the magnetic fields generated upon a high level short circuit of fault condition.

FIGS. 6 and 7 show an insulator 35 between the arc stack 36 and the over-molded magnet 34. An insulator 33 is placed between the over-molded magnet 34 and the compartment separation wall 44 (FIG. 2). Side inserts 39 and bottom insert 37 are inserted into the over-molded magnet, wherein the bottom insert 37 being provided with notches that engage with tabs on the side inserts 39 to interlock the inserts securely together inside the over-molded magnet 34. Side inserts 39 are inserted into the over-molded magnet 34 prior to the insertion of the bottom insert 37 and are positioned between grooves that are formed in the thermoplastic insulation that is molded around the over-molded magnet 34. These grooves are located on the top inside wall of the opening in the over-molded magnet 34. The side and bottom inserts protect the thermoplastic insulation on the inside of the over-molded magnet. By producing an ablative gas during contact separation, the ablative gas creates a pressure that pushes the arc, that is generated during the contact separation, away from the movable and stationary contacts 26 and 28 respectively (FIG. 3) and into the arc and baffle stacks 36 and 38 respectively.

OPERATING MECHANISM

Figure 9:
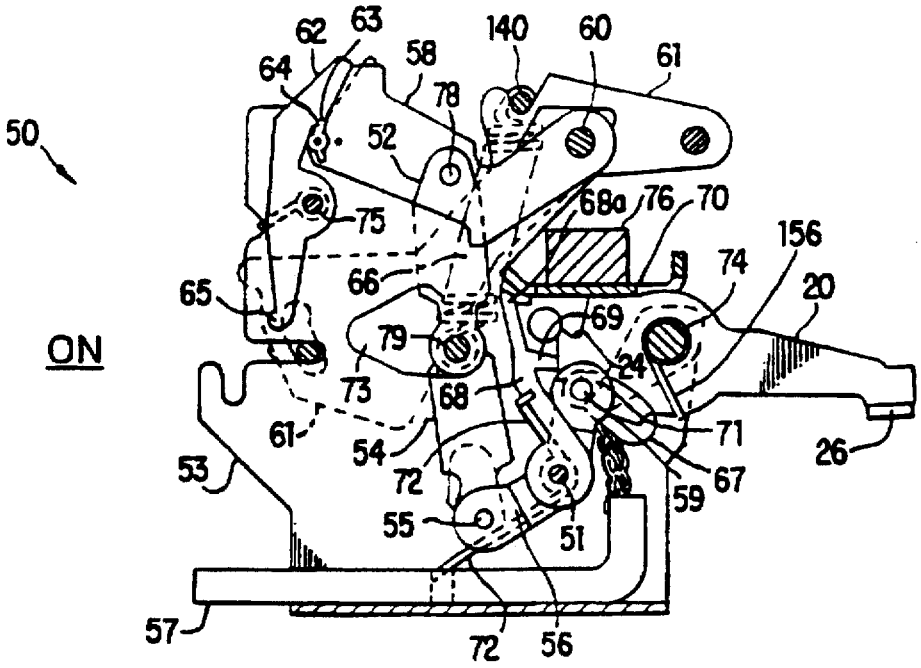
FIGS. 9, 9*a*–9*c* are cross sectional views of the operating mechanism of the current limiting circuit breaker of FIG. 1, taken generally along the line 9—9 of FIG. 2.
Figure 8:
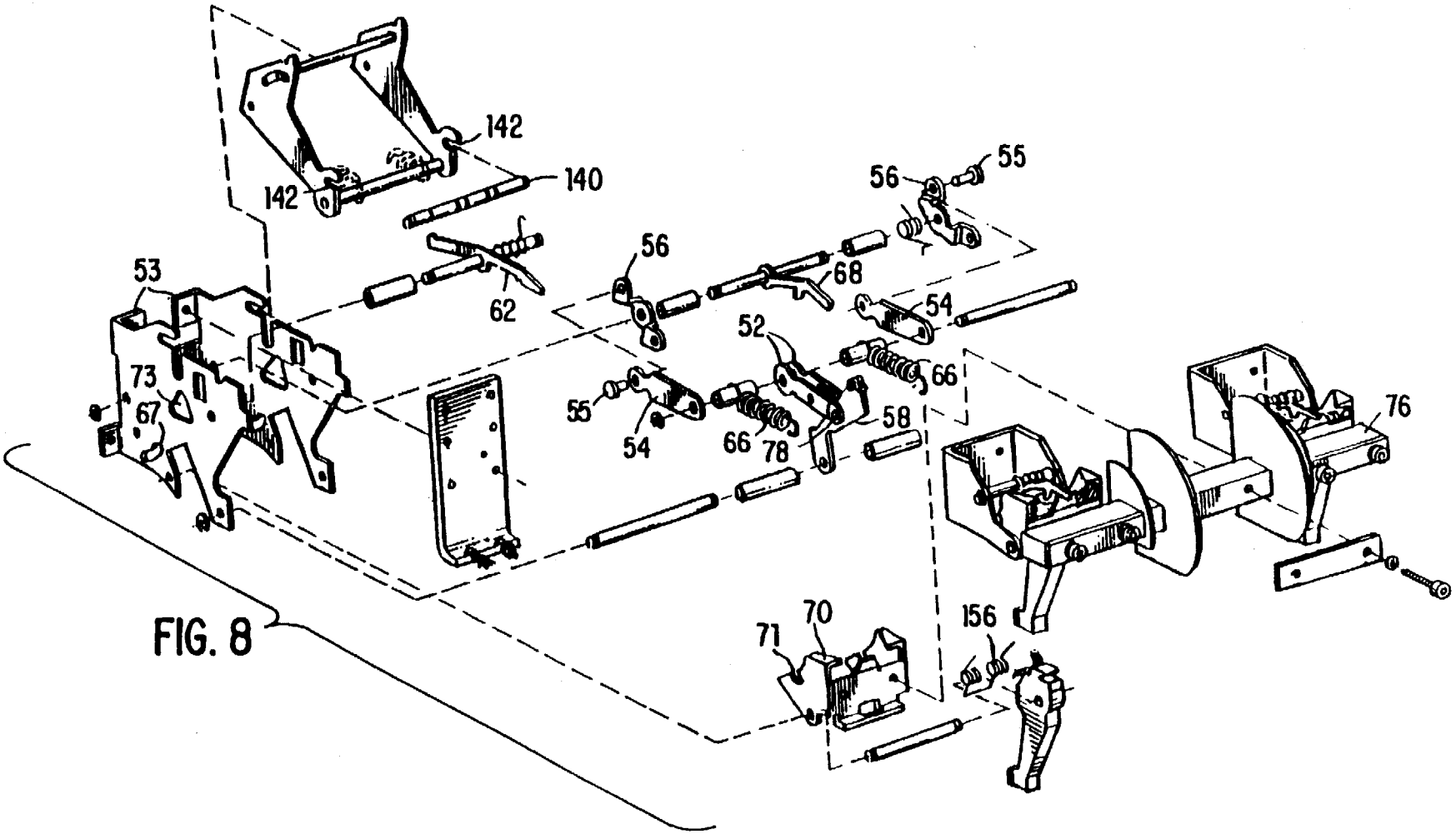
FIG. 8 is an enlarged, exploded, perspective view of an assembly of the operating mechanism of the current limiting circuit breaker of FIG. 1.

Now referring to FIGS. 8, 9, **9*a*–9*c*, 11, and 12, the operating mechanism generally indicated by 50 is shown including a pair of upper toggle links 52, a pair of lower toggle links 54, a pair of identical bell cranks 56, a cradle 58, a main latch 62, a roller latch 64, a pair of identical tension springs 66 (shown in phantom lines), a blade catcher 68, a blade carrier 70, a cross bar 76 (shown in FIG. 2), and a torsion spring 72 positioned between two mechanism sides 53 (only one side is shown in FIG. 9**).

The upper ends of the upper toggle links 52 are pivotally connected to the cradle 58 with pivot pin 78. The lower portions of the upper toggle links 52 are pivotally connected to the upper portion of the lower toggle links 54 with toggle pin 79. Toggle pin 79 has shoulder portions at the ends that engage with the edges of triangular shaped link apertures 73 in the mechanism frame sides 53. Lower portions of lower toggle links 54 are pivotally connected to the lower ends of boomerang shaped bell cranks 56 at pivot pin 55 that is attached to its corresponding bell crank 56. The upper ends of the bell cranks 56 have camming pins 59 attached thereto that cooperate with a bell crank drive pin slot 67 in the mechanism frame sides 53 and engages a positioning slot 71 (FIG. 8) in the blade carrier 70. The middle of the bell cranks 56 is pivotally mounted about catcher pivot pin 51 which is secured to the mechanism frame sides 53.

Figure 5:
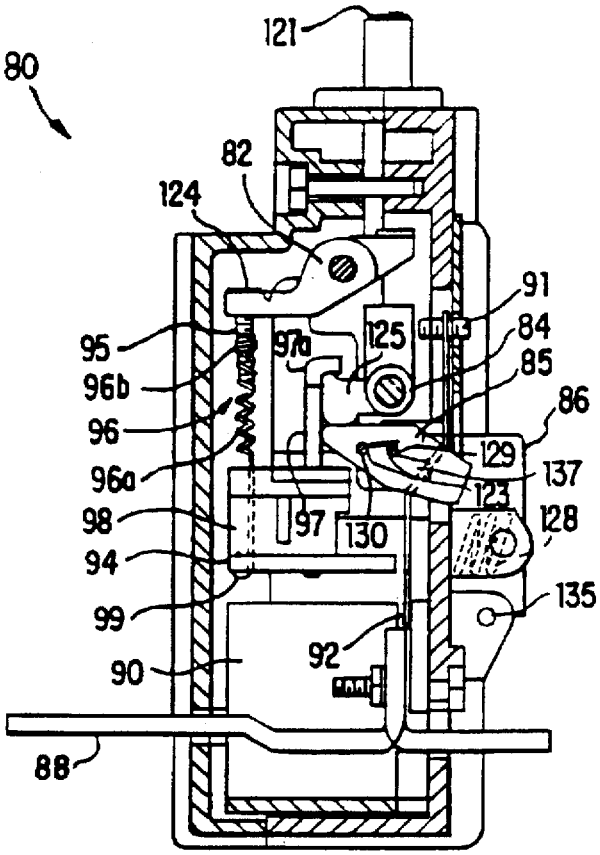
FIG. 5 is a cross sectional view of the trip unit used in the current limiting circuit breaker of FIG. 1, taken generally along the line 5—5 of FIG. 2.

The cradle 58 rotates about a cradle pivot pin 60, that is secured to the mechanism frame sides 53, at one end and has a generally u-shaped roller latch 64 attached thereto at the other end. The roller latch 64 straddles the cradle 58 and engages with main latch 62 when the circuit breaker is in the ON and NON-TRIPPED position. The middle of the main latch 62 is rotatably mounted to the mechanism frame sides 53 with main latch pivot pin 75. The main latch 62 includes a latch surface 63 formed therein, at one end, for engaging the roller latch 64 and a nub surface 65 formed thereon, at the opposite end, for cooperating with the trip unit hammer 86 (FIG. 5).

A pair of handle arms 61, in generally parallel relationship to one another, are attached to and rotate about handle pin 77 (seen in FIG. 9*b*) that is attached to the mechanism frame sides 53. One end of a pair of tension springs 66 is attached to reset pin 140 having ends that are inserted into handle arm slots 142 (shown in FIG. 8), the opposite end of the pair of tension springs attaches to the toggle pin 79. Reset pin 140 has a groove therein for sliding on the top surface of the cradle during a reset operation.

A blade crossbar 76 is connected to the blade carrier 70 of all three poles to cause all three blade carriers 70 to move simultaneously in response to the opening or closing of the operating mechanism 50.

When the operating handle 18 is in the ON/CLOSED position the operating mechanism 50 parts are in position as shown in FIG. 9. The upper and lower links 52 and 54 respectively are in the overcenter position as shown and having tension springs 66 supplying an upward tension on toggle pin 79. The spring force that is applied to toggle pin 79 is transferred to the cradle 58, through the upper toggle links 52, forcing the roller latch 64 to engage latching surface 63 and maintain the operating mechanism in the ON/CLOSED position.

Figure 9A:
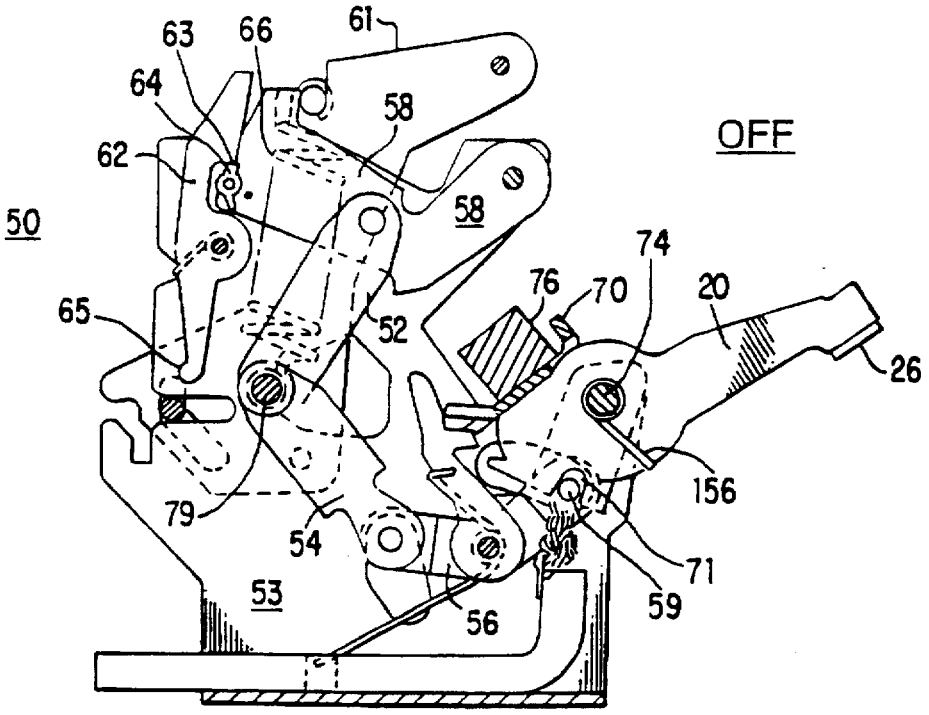
Figure 9B:
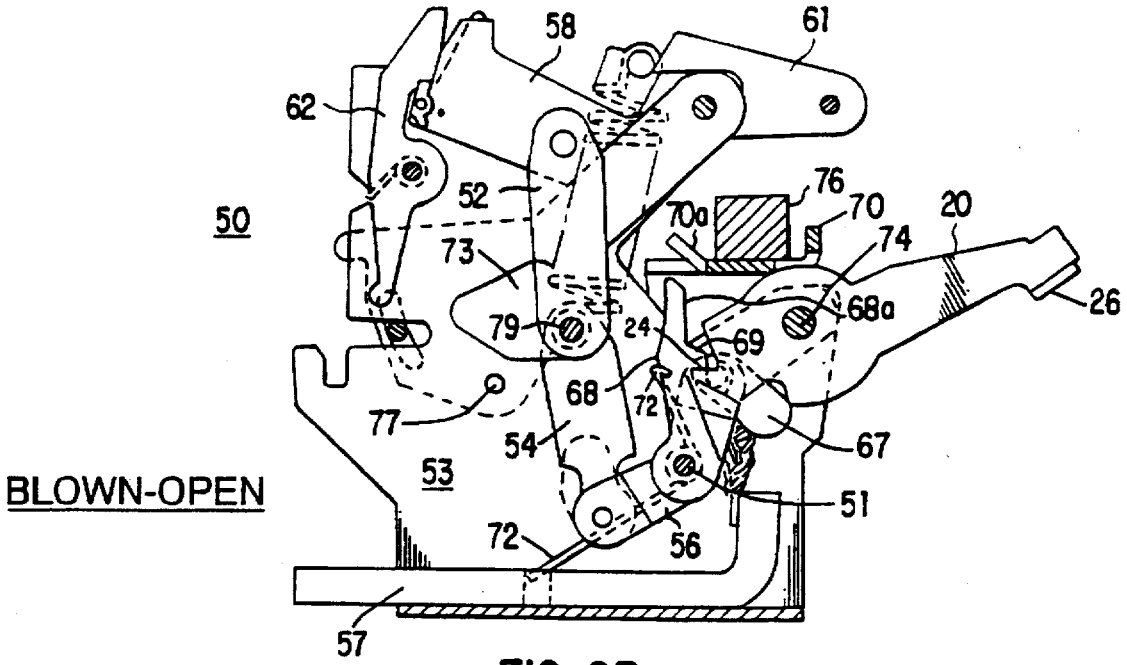
Figure 9C:
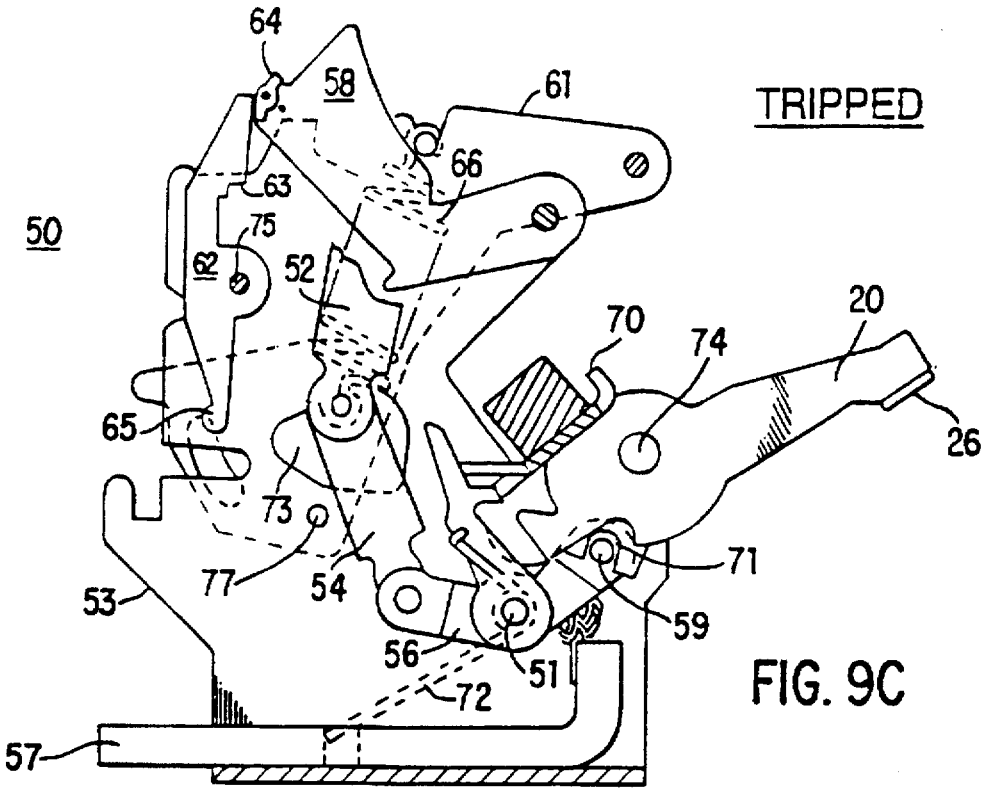

FIG. 9*c* shows the operating mechanism 50 in a TRIPPED position. When the trip unit (FIG. 5) senses an overcurrent or fault condition it releases hammer 86, (shown in FIG. 5), which in turn strikes nub surface 65, on the main latch 62, wherein rotating main latch 62, about main latch pivot pin 75, causing latching surface 63 to move away from roller latch 64. The tension from the tension springs 66 forces cradle 58 to swing upward pulling upper toggle links 52 upward and placing toggle pin 79 in position of the link aperture 73 as shown in FIG. 9. As a result, the upper toggle links 52 and lower toggle links 54 bend at their common point at toggle pin 79, thereby resulting in the upper toggle links 52 pulling the lower toggle links 54 upward which in turn rotates the bell cranks 56 about catcher pivot pin 51. The upper end or bell cranks 56 translates into the positioning slot 71 as shown in FIG. 9*c*, forcing the blade carrier 70 to rotate about blade pivot 74 and separating the movable and stationary contacts.

FIG. 9*a* shows the operating mechanism when the operating handle is in the OFF position. FIG. 9*b* shows the operating mechanism when a BLOW-OPEN condition occurs. Upon the occurrence of an extremely high fault current, the current limiting function will cause the circuit breaker to open before the mechanism has sufficient time to operate. The current flowing through the blade 20 is generally parallel to and opposite in direction to the current flowing through the adjacent portion of the current path 42 (FIG. 3). when the current through the circuit breaker reaches a certain level, the electromagnetic force created by the current through the blade 20 and the current in the opposite direction in the current path 42 causes the contacts to BLOW-OPEN, as shown in FIG. 9B. The electromagnetic force is greatly increased by the over-molded magnet 34 (FIG. 3) completely surrounding the contacts and a portion of the opposing current paths, enabling the circuit breaker to interrupt the current very quickly.

An arc is drawn between the movable contact 26 and stationary contact 28 as the contacts BLOW OPEN. The blade 20 is held open by a blade catcher 68 (FIG. 9*b*) so that the circuit breaker operating mechanism 50 has time to raise the blade crossbar 76 to hold the blade 20 open.

A torsion spring 72 is pivotally mounted about catcher pivot pin 51 and having one end positioned against the mechanism terminal 57 and the other end is forcibly engaged with blade catcher 68 for biasing the blade catcher in a clockwise rotation towards the blade 20. The blade 20 is attached to blade carrier 70 and pivots about blade pivot 74. Blade catcher 68 has a catcher nose 69 that catches an open blade when the mechanism does not open soon enough. The blade catcher 68 retains the blade in an open position until the mechanism responds by opening the mechanism upper and lower toggle links 52 and 54.

The method that is used to "catch" the BLOWN OPEN blade will now be discussed. When the blade 20 is in the CLOSED position (FIG. 9), the torsion spring 72 biases the catcher nose 69 against the blade protrusion 24. As the blade begins to open, due to direct electromagnetic repulsion, the catcher 68 starts to rotate as the blade 20 and blade protrusion 24 moves rotatably around blade pivot 74. During the BLOW OPEN process the blade carrier 70 remains stationary. When blade protrusion 24 passes by catcher nose 69, the catcher 68 continues to rotate about catcher pivot pin 51 until the catcher nose 69 overlaps the blade protrusion 24, thereby preventing the blade 20 from returning to the CLOSED position. To release the blade 20 and return it to its normal relationship with the blade carrier 70, the circuit breaker trip unit 80 senses the fault that produced the BLOW OPEN actuation. When the trip unit 80 "TRIPS" the operating mechanism 50, the upper and lower toggle links move to rotate the bell crank 56 which rotates the blade carrier 70 until blade carrier tab 70*a* (shown in FIG. 9*b*) strikes the top surface 68*a* of catcher 68 causing the catcher 68 to rotate away from blade protrusion 24 until the overlap between catcher nose 69 and blade protrusion 24 is alleviated. Then the blade 20 being biased by blade spring 156 (best shown in FIG. 9) will return to normal relationship with the blade carrier 70.

TRIP UNIT

Figure 4:
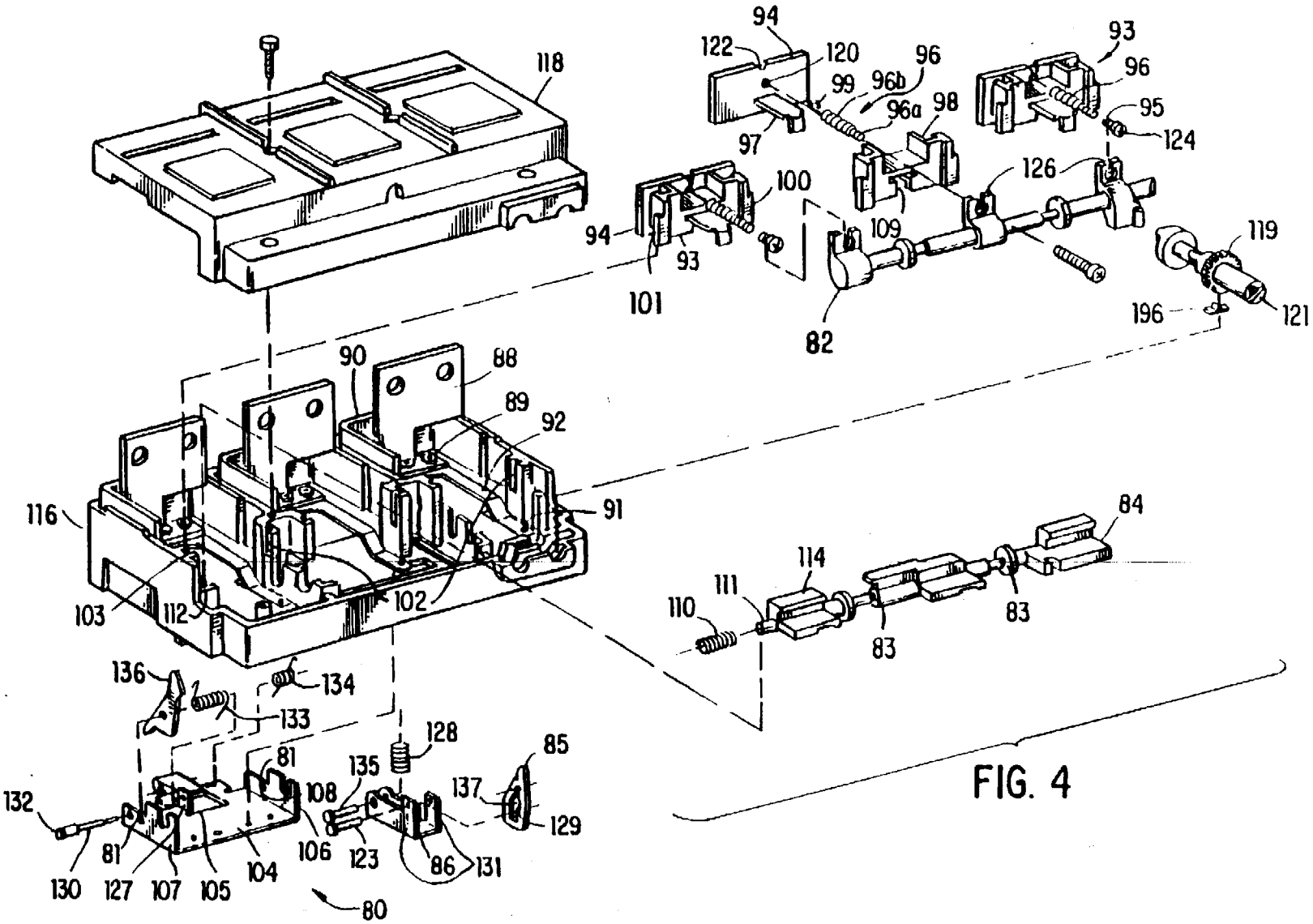
FIG. 4 is an enlarged, exploded, perspective view of an assembly of the trip unit of the current limiting circuit breaker of FIG. 1.
Figure 10:
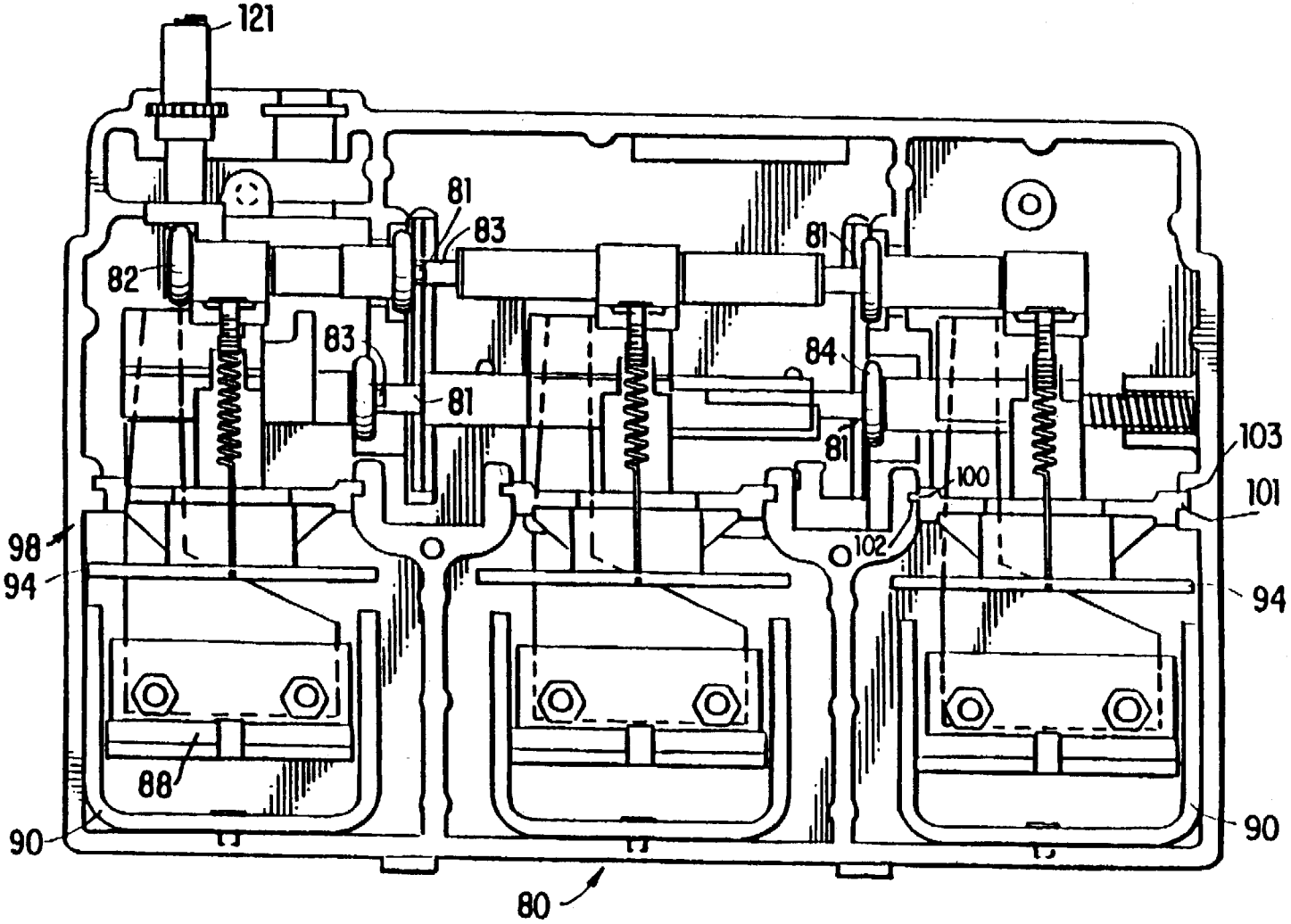
FIG. 10 is a plan view of the trip unit having the cover removed of the current limiting circuit breaker of FIG. 1.

Now referring to FIGS. 4, 5 and 10, a trip unit 80 is shown being enclosed in a molded plastic trip unit housing 116 having cover 118 and includes an u-shaped yoke 90, an armature assembly 93, an armature guide 98, a trip cross bar 84, a trip unit latch 85 (see FIG. 5), a hammer 86, and a bimetal 92.

The magnetic adjust and trip cross bars 82 and 84, respectively, have identical steel shafts extending through their centers that have selected areas that are milled to a "D" cross-section 83. The trip unit frame sides 106 and 107 have cross bar retaining slots 81 having bottom circular apertures 108 with a diameter greater than the width of their respective slots. The cross bars' steel shaft diameter is slightly smaller than the slot aperture diameter, but larger than the slot width. Therefore, the "D" cross sectional areas 83 allows the magnetic adjust and trip cross bars to be inserted into cross bar retaining slots 81 only at specific orientations. These orientations are impossible to duplicate upon complete assembly of the trip unit 80, hence, the parts are self-locking. Compression spring 110 (shown in FIG. 4) is disposed within spring slot 112 surrounding trip cross bar end 111 therein and between trip unit housing 116 and cross bar block 114. After the trip cross bar 84 is installed into cross bar retaining slots 81 the compression spring 110 forces trip cross bar 84 to slide horizontally so that the "D" cross section area 83 is displaced from the cross bar retaining slot 81, thereby securing the trip cross bar 84 in place.

Figure 14:
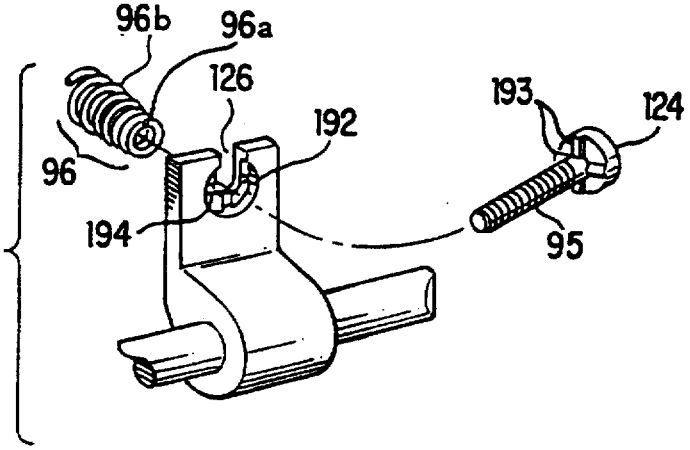
FIG. 14 is an exploded perspective view of a portion of the trip cross bar of the current limiting circuit breaker of FIG. 1.
Figure 11:
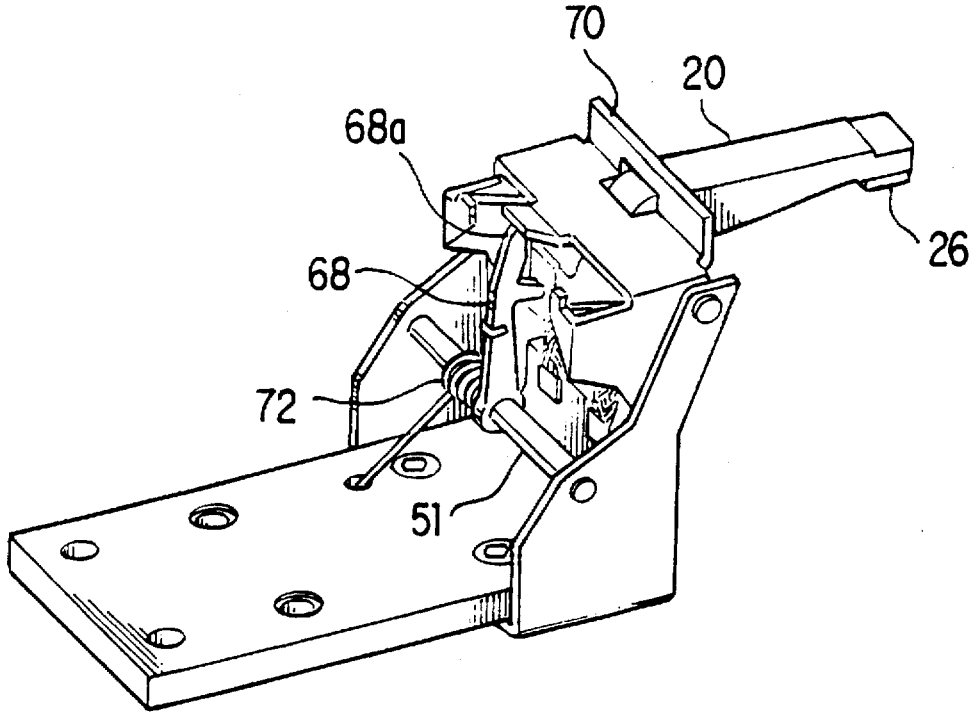
FIGS. 11 and 12 are perspective views of the blade assembly of any one pole of the current limiting circuit breaker of FIG. 1.
Figure 12:
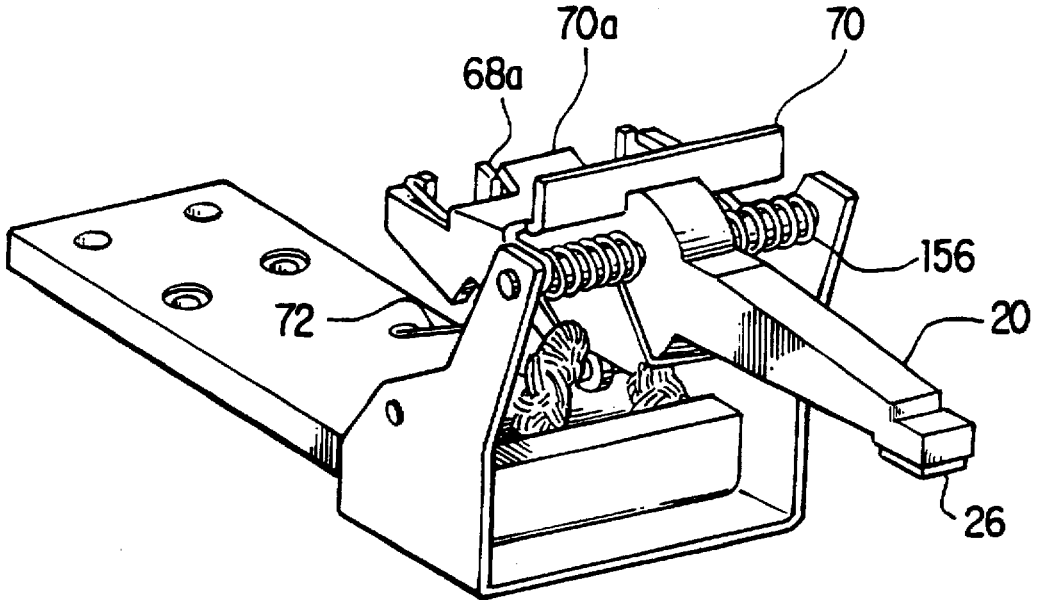

The magnetic portion of the trip unit 80 will now be discussed. The trip unit current path 88 is surrounded by an u-shaped metallic yoke 90. An armature assembly 93 is located proximate the yoke 90 and includes an armature shaft 97 passing through aperture 109 in the armature guide 98 and being attached to an armature plate 94 using a well known riveting or staking process. The armature guide 98 has tabs 100 and 101 that slide into housing slots 102 and 103 respectively. Housing slot 102 is sized to receive armature tab 100 and housing slot 103 is sized to receive armature tab 101. Armature tabs 100 and 101 are of different sizes so that the armature assembly 93 can not be installed incorrectly. Armature assembly 93 also includes a magnetic adjust assembly that includes a magnetic adjust screw 95 and armature spring 96. Armature spring hook 99 is anchored to armature plate 94 by cooperating with aperture 120 and v-shaped notch 122. Magnetic adjust screw head 124 engages with magnetic adjust crossbar 82 by sliding through slot 126 (FIG. 14) and is biased down into a cavity 192 (FIG. 14) by magnetic adjust screw 95 spring force. Additionally, the magnetic adjust screw 95 has embossments 193 (FIG. 14), at 90 degree intervals, that engage with detents 194 (FIG. 14) to provide fixed adjustment increments and eliminate the need for locking agents. Magnetic adjust screw 95 engages three non-active coils **96*a* of the armature spring 96 reserved exclusively for engaging the magnetic adjust screw 95, not for the purpose of adding force. The wind-up problem that exists in the prior art is solved by only engaging the non-active coils because no additional spring coils can be engaged, regardless of adjustment screw position. The armature spring 96 is wound with the active coils 96*b* wound with an inside diameter slightly larger than the outside diameter of the magnetic adjust screw 95, thusly the magnetic adjust screw 95** never touches the active coils of the spring and cannot effect the spring rate thereof. The spring force remains linear as the magnetic adjust screw engages or disengages the armature spring. Thusly, the magnetic force required to trip the circuit breaker will change linearly as the magnetic adjust screw engages and disengages the non-active coils of the armature spring. Therefore, the linear response solves the problems of the prior art by providing a dependable calibration means.

Referring now to FIGS. 4, 5, and 10 the stored energy section of the trip unit is shown having trip unit frame 104, hammer 86, trip latch 85, latch pivot pin 130, and a trip unit main compression spring 128. Trip unit frame 104 is secured to the outside of trip unit housing 116 having trip unit frame aperture 105 therein, and mounting tab 127 extending therefrom and into the trip unit housing 116. The hammer 86 is pivotally mounted between hammer securing is tabs (not shown) by hammer pivot pin 135. Trip unit main compression spring 128, disposed between hammer 86 and trip unit frame 104, forces the hammer 86 in a rotational direction away from the trip unit frame 104, in the TRIPPED position. The trip latch 85 being of tear-drop shape and having an aperture 137 therein is secured between the walls 131 of hammer 86 by latch pivot pin 130 passing through the aperture 137 and securing to the hammer walls 131. Latch pivot pin 130 is a one piece part that has been milled to have different diameters. Trip latch 85 rotates about latch pivot pin 130, while latching surface 129 engages latch pin 123 (FIG. 5) to hold the hammer 86 in a latched position. The latch pin 123, having each end disposed in apertures in the hammer walls 131, passes through the aperture 137 in the trip latch 85 and engages the latching surface 129 when the circuit breaker is in the ON position. When the circuit breaker is in the ON position, the compression spring 128 is compressed between the trip unit frame 104 and the hammer 86 thereby holding the latch pin 123 in engagement with the latching surface 129 due to the force created by the compressed compression spring 128 pulling the latch pin 123 against the latching surface 129. The trip latch torsion spring 134 is positioned around the latch pivot pin 130 and has a hook at each end that engages mounting tab 127 at one end and the trip latch 85 at the other end, for biasing the trip latch 85 into a latched position. Reset arm torsion spring 133 is placed around the latch pivot pin 130 and engages the trip unit frame 104 at one end and hooks onto the reset arm 136 at the other end, wherein the reset arm 136 rotates about latch pivot pin 130.

The trip unit theory of operation, for the magnetic portion, will now be discussed. As current flows through the trip unit trip unit current path 88 a magnetic flux is generated that flows through the magnetic circuit, comprising yoke 90 and armature plate 94, generating a magnetic force that pulls the armature plate 94 towards the yoke 90. The magnetic force counteracts the armature spring 96 biasing force and pulls the armature assembly 93 towards the yoke 90. When the current, flowing through the current path, increases the magnetic force increases causing the armature assembly 93 to move closer to the magnetic yoke, forcing the armature shaft hook **97*a* (FIG. 5) to come into contact with the trip cross bar 84 thereby causing it to rotate. When the current exceeds a predetermined value, the electromagnetic force is so great that the armature assembly 93 rotates the trip crossbar tab 125 into the trip latch 85. The trip latch 85 then rotates moving the latching surface 129 away from latch pin 123 releasing the trip unit main compression spring 128. The compression spring 128 expands outwardly from the trip unit frame 104 and that forces the hammer 86 to rotate about hammer pivot pin 135, thereby causing the hammer to strike the main latch nub surface 65 (FIG. 9**).

The magnetic tripping range of the trip unit is varied by rotating the magnetic adjustment knob 121. This motion is translated, via a helical end of the adjustment knob, into a rotary movement of the magnetic adjust crossbar. This rotation will lengthen/shorten the armature springs and adjust the biasing force of the assembly (ie. longer springs= higher magnetic trip level). The magnetic adjust knob 121 has detents 119 that cooperate with the detent spring 196, that is inserted into the trip unit cover, to provide and maintain digital, tactile adjustments of magnetic trip current level.

Figure 13:
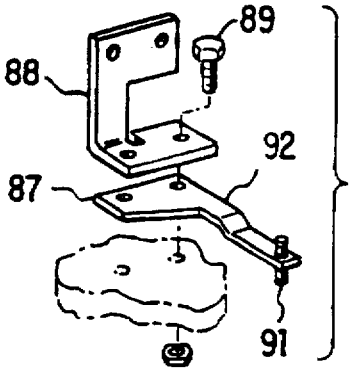
FIG. 13 is a perspective view of the bimetal assembly of the current limiting circuit breaker of FIG. 1.

The thermal portion of the trip unit will now be discussed. By using a parallel current path through the trip unit, a portion of the current is split to directly heat the bimetal, while the remaining portion is used to indirectly heat the bimetal. As shown in FIG. 13, the main component of the thermal portion is a generally L-shaped bimetal 92 that has its base portion 87 fastened to the current path 88 by fasteners 89. Bimetal elongated portion extends towards and proximate to the trip cross bar 84. As shown in FIG. 5 a calibration screw 91 passes through a threaded aperture in the elongated portion. A parallel current path through the trip unit is utilized by having a portion of the current split to directly heat the bimetal and having the remaining portion used to indirectly heat the bimetal. In this way, the bimetal can react with the same quick dynamic response as a directly heated bimetal and yet not incur the resistance penalty which is not tolerable in a large frame circuit breaker. Unlike other shunted bimetals, current is routed only through the highest activity portion of the bimetal therefore optimizing the bimetal output for the least resistance gain. As current flows through the trip unit current path 88 and the bimetal base portion 87 (FIG. 13) of the bimetal, the bimetal is heated and will bend in proportion to the amount of the heat generated. When a predetermined amount of current is exceeded for more than a predetermined amount of time, the calibration screw 91 engages the trip cross bar 84 (best shown in FIG. 5) and forces it to rotate and delatch the trip latch 85 as previously discussed.

In addition to providing overcurrent sensing, the trip unit also provides the field installable accessory and customer interface for manual trip operations. The shunt-trip and undervoltage-trip accessories transmit their trip signals, via the push-to-trip actuator 186 (FIG. 2), directly to the trip cross-bar 84 causing it to rotate in a manner similarly to either a magnetic or thermal overcurrent. This will result in a trip signal being sent to the circuit breaker operating mechanism 50 (FIG. 9) via the trip unit hammer 86 and main latch 62 (FIG. 9). In addition, since undervoltage devices are typically not self-resetting, the reset arm 136 (FIG. 4), cooperating with the operating mechanism handle arm 61 (FIG. 9), trip unit crossbar 84, and push-to-trip actuator 186, will provide the resetting motion/energy for such devices. Typically, this energy/motion is derived either from the blades/crossbar or the operating handle arm directly. Using this system has the advantages of being inherently "kiss-free" and enables accessory pockets 152 (FIG. 2) to be universal; for example, allowing switches, shunt-trips, and Under Voltage Relays (UVR's) to be used in either or both poles.

JAWS/CONNECTORS

Figure 15:
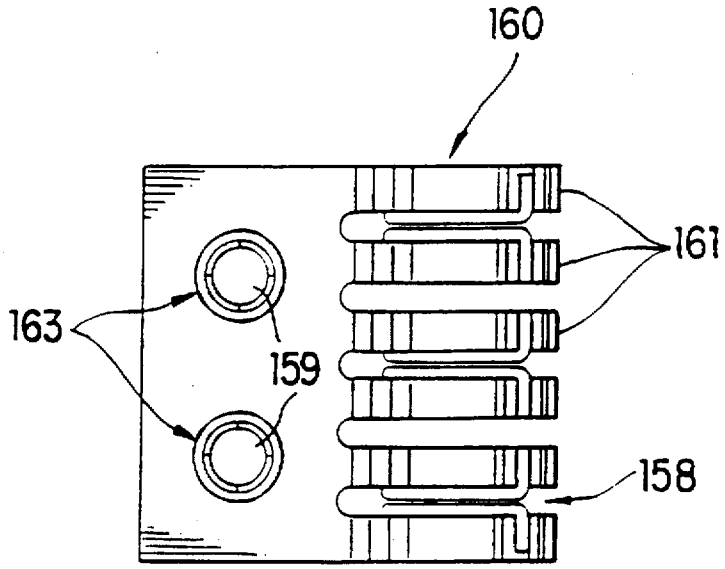
FIG. 15 is a plan top view of the jaw assembly of the current limiting circuit breaker of FIG. 1.
Figure 16:
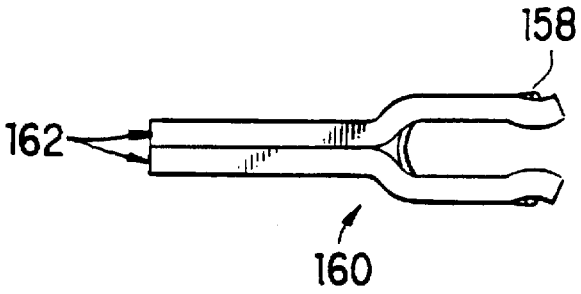
FIG. 16 is a plan side view of the jaw assembly of the current limiting circuit breaker of FIG. 1.

As shown in FIGS. 15 and 16 a jaw connector 160 is shown being of identical halves 162 having jaw mounting holes 159 and a plurality of fingers 161 integral thereto. The jaw halves 162 are joined together by incorporating an extrusion 163 of the jaw material around the perimeter of the jaw mounting screw holes 159. This material is subsequently swedged to secure both jaw halves. Prior to swedging the jaw halves together, back-up springs 158 are loaded into the swedging fixture. After the swedging process the back-up springs bias the plurality of fingers together.

The jaws are fastened to the terminals of the breakers by the usage two high-strength fasteners with safety washers per phase. Spacing of the jaws, appropriate to the I-line application, is accomplished by the usage of copper extrusions that are cut to the exact length of the spacings if the I-line buss. No spacer is required on one terminal as it was designed to be located at the proper height for that phase.

As the terminals of the breaker have only clearance holes (this was intentional, it provides for proper flexibility in providing to the different connector systems), the jaw fasteners are secured with terminal insert clips. These devices snap fit onto either end of the breaker, when threads are required (I-line, buss, and crimp-on connector applications). This device snaps together and snap assembles to the terminals of the breaker. When assembled on the breaker, it is self-locating and must be tool removed. This was to prevent the inadvertent misassembly of the clip during connector assembly.

FIELD INSTALLABLE ACCESSORIES

The accessories utilize the snap together feature as taught by U.S. Pat. No. 5,005,880 which is assigned to the assignee of the present application and incorporated herewith by reference, to secure them to the circuit breaker.

Figure 17:
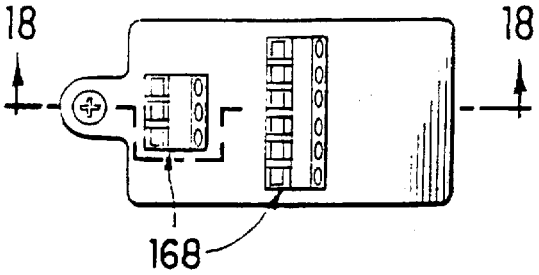
FIG. 17 is a plan top view of an accessory of the current limiting circuit breaker of FIG. 1.
Figure 18:
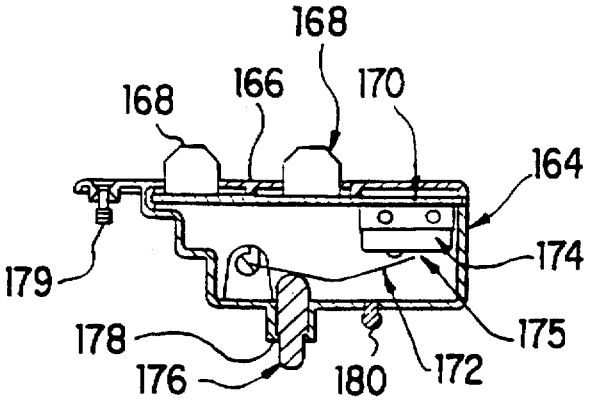
FIG. 18 is a cross sectional view of an accessory of the current limiting circuit breaker of FIG. 1, taken generally along the line 18—18 of FIG. 17.
Figure 19:
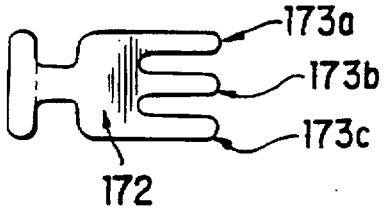
FIG. 19 is a plan top view of an actuator plate of the accessory of FIG. 18 of the current limiting circuit breaker of FIG. 1.

FIGS. 17–19 show an auxiliary switch comprising an accessory case 164, accessory cover 166, terminal blocks 168, circuit board 170, actuator plate 172, switches 174, and plunger 176. The auxiliary switch components are assembled into accessory case 164 and an accessory cover 166 is then secured to the base. One end of plunger 176 extends through aperture 178 and engages with the push-to-trip actuator 186 (FIG. 2) while the other end engages actuator plate 172. Actuator plate 172 is pivotally mounted to the accessory case 164 at one end and has three acuator plate fingers **173*a*, 173*b*, 173*c* (FIG. 19) at the other end that actuate switches 174 by engaging switch actuators 175. Up to three switches may be mounted to circuit board 170 which electrically connects them to corresponding terminal blocks 168, also mounted to circuit board 170. Wires are easily connected to the terminal blocks to allow for external devices to determine the status of the circuit breaker. The use of the terminal blocks 168 eliminates the need to solder individual wires to the switch actuator. Nub 180 on the outside of accessory case 164 "snaps" into a snap receptacle 150 (FIG. 2) on the circuit breaker cover 14 (FIG. 2) similar to the teaching of U.S. Pat. No. 5,005,880. Screw 179 further secures the accessory to the circuit breaker cover 14**.

The auxiliary switch is actuated by blade crossbar 76 (FIG. 2) and accessory actuator 182 (FIG. 2) when the circuit breaker is in the ON position. In this position, plunger 176 is forced upward into actuator plate 172 rotating the acuator plate fingers **173*a*, 173*b*, 173*c* in a counterclockwise direction into the switch actuators 175, thusly actuating the switches 174. When the circuit breaker is in the OFF position, crossbar 76 rotates out of position and allows accessory actuator 182 to lower which allows plunger 176 to disengage the actuator plate 172, thereby allowing for the actuator plate fingers to disengage all of the switches 174**.

Figure 20:
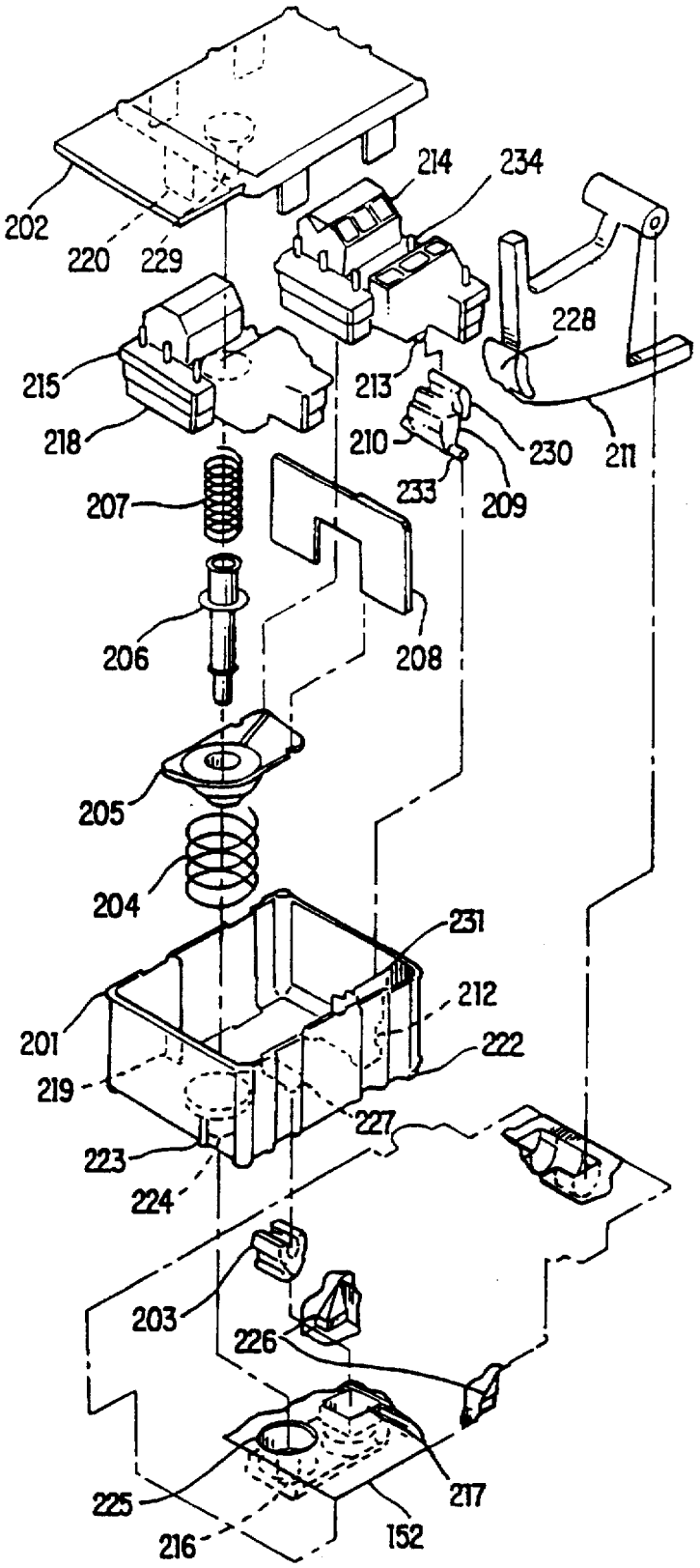
FIG. 20 is a perspective view of an accessory assembly of the current limiting circuit breaker of FIG. 1.

Now referring to FIG. 20, another embodiment of the accessories is shown. The switch and bell alarm consists of a molded thermoplastic base 201 made of G.E. Lexan® 141 which assembles to a molded cover 202 made of the same material. Located within the switch assembly in order of assembly are the lower actuator spring 204, actuator plate 205 made of Rynite 555, thermoplastic actuator plunger 206 made of Rynite 555, thermoplastic support plate 208, top plunger return spring 207, thermoplastic bell alarm actuator 209 assembled with spring steel actuator 210 and various combinations of terminal switch circuit board assemblies 214 and 215 with two terminal switch assemblies, the maximum possible within module case.

Installation of the alternate accessory embodiment will now be discussed. Auxiliary switch and bell alarm module may be installed in either of the two accessory pockets located in circuit breaker cover. Module is guided into position by a rib 222 on both sides of module and positioning nubs 223 located on plunger housing hub 224. These features interface with features 225 and 226 of accessory pocket 152. As module is guided into place, snap 227 on bottom of module contacts "self-sealing snap in receptacle" 203 (described in U.S. Pat. No. 5,005,880, which is assigned to the assignee of the present application and is incorporated herewith by reference) which is already installed in snap pocket 217 before circuit breaker leaves the factory. With a slight amount of downward force, snap engages snap receptacle and the module is held securely in place. This allows module to interface at two points in accessory pocket. First it allows the bell alarm actuator 209 to engage Push-To Trip (PTT) accessory trip actuator 211 at interface point 228. This actuation point is used to sense a "tripped breaker condition", and secondly, it allows end of actuator plunger 206 to interface with blade crossbar at interface point 216. This actuation point is used to sense a "breaker ON condition".

An alternate auxiliary switch will now be discussed. Auxiliary switch is actuated by blade crossbar when circuit breaker is in the ON/CLOSED position. In this position, actuator plunger 206 is forced upward and is guided in its sliding motion by a molded slip shaft 229 on module cover 202. In this position, plunger return spring 207 is compressed between module cover 202 and spring seat feature on top portion of actuator plunger 206. When spring 207 is compressed, this allows lower actuator spring 204 to force actuator plate 205 to slide on main body of actuator plunger 206 and actuate all microswitches in any combination that may be installed within the module. Microswitches 218 are mounted and soldered to a printed circuit board 234 which connects them directly to three wire terminal blocks 214 also mounted and soldered to printed circuit board. Each microswitch is connected to its own terminal block through traces on printed circuit board. These circuit board assemblies are supported by molded in ledges in module base 201 and by support plate 208. They are held securely in module by module cover 202, which attaches securely to module base with the help of molded snap features 219 and 220 at five locations.

When circuit breaker is in OFF/OPEN position, blade crossbar rotates out of position and allows plunger 206 to disengage. Once plunger is disengaged, upper plunger spring 207 will overcome force created by actuator spring 204 and return actuator plate 205 to its normal position, thereby disengaging all microswitches on terminal switch circuit board assemblies.

A bell alarm will now be discussed. Bell alarm is actuated when circuit breaker is tripped and its purpose is to indicate a tripped condition in circuit breaker. Bell alarm actuator 209 is installed by inserting interfacing actuator portion of switch 230 through opening 231 module into module base 201. Once actuator is inserted through module wall, rotating pin feature 233 molded into switch can be snapped into pivot feature 212 molded into module base 201. Once terminal switch circuit board assembly 234 is installed, bell alarm actuator 209 is forced forward by leaf spring 213 mounted with rivets to a microswitch positioned directly over bell alarm actuator 209, forcing the bell alarm actuator forward. Microswitch is actuated when circuit breaker is reset and PTT accessory trip actuator is forced back and interfaces with bell alarm switch interface 230. This causes spring steel actuator 210 to engage microswitch. When circuit breaker is tripped, leaf spring 213 forces bell alarm actuator 209 forward against stops in module base 201, thereby disengaging the microswitch which controls bell alarm circuit.

While there have been shown and described what are at present considered the preferred embodiments of the invention, it will be obvious to those skilled in the art that various changes and modifications may be made therein without departing from the scope of the invention as defined by the appended claims.

What is claimed is:

1. A circuit interrupter comprising:

a molded case;

a pair of separable contacts within the case;

an operating mechanism within the case for separating and closing the separable contacts, into OPEN and CLOSED positions, respectively;

a cradle pivotally mounted to the case;

a latch pivotally mounted to one end of the cradle;

a main latch pivotally mounted within the case, the main latch having a latching surface for cooperating with the latch, whereby the main latch cooperates with the latch to hold the separable contacts in the CLOSED position; and a trip unit, disposed proximate to the operating mechanism, for sensing current flowing through the pair of separable contacts and articulating the operating mechanism to separate the pair of separable contacts when the current exceeds a predetermined amount, the trip unit comprising:

a housing;

a current path disposed in the housing;

an actuating member disposed on the housing for moving the main latch away from the latch to allow the operating mechanism to separate the pair of separable contacts when the current exceeds the predetermined amount;

a frame disposed on the housing;

a trip cross bar rotationally secured in said frame for interacting with the actuating member to allow the contact separation; and a generally L-shaped bimetal having a base portion disposed in the current path and an elongated portion extending from the base portion toward the trip cross bar, the elongated portion having an end disposed proximate the trip cross bar, wherein the current flows from one end of the base portion to its other end and the elongated portion bends in response to excess current flowing through the current path so that the end of the elongated portion engages the trip cross bar causing the trip cross bar to rotate thereby articulating the operating mechanism to separate the pair of separable contacts when the current exceeds the predetermined amount.

2. The circuit interrupter according to claim 1, further including a calibration screw threaded into an aperture disposed in the end of the elongated portion for adjusting the predetermined current level, the calibration screw being adapted for engagement with the trip cross bar.

3. A circuit interrupter comprising:

a molded case;

a pair of separable contacts within the case;

an operating mechanism within the case for separating and closing the separable contacts, into OPEN and CLOSED positions, respectively;

a cradle pivotally mounted to the case;

a latch pivotally mounted to one end of the cradle;

a main latch pivotally mounted within the case, the main latch having a latching surface for cooperating with the latch, whereby the main latch cooperates with the latch to hold the separable contacts in the CLOSED position; and a trip unit, disposed proximate to the operating mechanism, for sensing current flowing through the pair of separable contacts and articulating the operating mechanism to separate the pair of separable contacts when the current exceeds a predetermined amount, the trip unit comprising:

a housing;

a current path disposed in the housing;

an actuating member disposed on the housing for moving the main latch away from the latch to allow the operating mechanism to separate the pair of separable contacts when the current exceeds the predetermined amount;

a frame disposed on the housing;

a trip cross bar rotationally secured in said frame for interacting with the actuating member to allow the contact separation; and a bimetal having a first portion disposed in the current path and a second portion extending from the first portion toward the trip cross bar, the second portion having an end disposed proximate the trip cross bar, wherein the current flows from one end of the first portion to its other end and the second portion bends in response to excess current flowing through the current path so that the end of the second portion engages the trip cross bar causing the trip cross bar to rotate thereby articulating the operating mechanism to separate the pair of separable contacts when the current exceeds the predetermined amount.

4. The circuit interrupter according to claim 3, wherein the bimetal is generally L-shaped.

* * * * *